US007740492B2

(12) United States Patent
Dei Rossi et al.

(10) Patent No.: US 7,740,492 B2
(45) Date of Patent: Jun. 22, 2010

(54) PORTABLE COMPUTER UNIVERSAL SERIAL BUS DEVICE WITH AN EXTENDABLE CONNECTOR SECURED BY MULTIPLE LOCKING MECHANISMS

(75) Inventors: Dwayne Dei Rossi, Irvine, CA (US); George Shiu, South Pasadena, CA (US)

(73) Assignee: Kingston Technology Corporation, Fountain Valley, CA (US)

( * ) Notice: Subject to any disclaimer, the term of this patent is extended or adjusted under 35 U.S.C. 154(b) by 136 days.

(21) Appl. No.: 11/643,302

(22) Filed: Dec. 21, 2006

(65) Prior Publication Data

US 2008/0153350 A1 Jun. 26, 2008

(51) Int. Cl.
*H01R 13/44* (2006.01)

(52) U.S. Cl. ..... 439/131; 439/141; 439/638

(58) Field of Classification Search ..... 439/131, 439/638, 135, 141

See application file for complete search history.

(56) References Cited

U.S. PATENT DOCUMENTS 6,456,500 B1 9/2002 Chen
6,612,853 B2 9/2003 Wu
6,676,419 B1 * 1/2004 Lin et al. ..... 439/76.1
6,733,328 B2 * 5/2004 Lin et al. ..... 439/501
6,743,030 B2 6/2004 Lin et al.
D494,969 S 8/2004 Lin
6,792,487 B2 9/2004 Kao
6,808,400 B2 10/2004 Tu
6,979,210 B2 * 12/2005 Regen et al. ..... 439/131
7,004,780 B1 * 2/2006 Wang ..... 439/353
7,037,120 B1 * 5/2006 Yeh ..... 439/131
7,070,425 B2 * 7/2006 Regen et al. ..... 439/131
7,407,390 B1 * 8/2008 Ni ..... 439/76.1
7,422,454 B1 * 9/2008 Tang et al. ..... 439/131
2006/0240692 A1 10/2006 Regen et al.
2006/0258224 A1 11/2006 Liao

* cited by examiner

*Primary Examiner*—Xuong M Chung-Trans
(74) *Attorney, Agent, or Firm*—Sawyer Law Group, P.C.

(57) ABSTRACT

An apparatus for use within an electrical devices is disclosed. The apparatus comprises a casing having an upper body and a lower body, the casing including a tab disposed on a surface thereof and an adjustable base having a plurality of tab cavities adjacent to the tab. The tab engagingly couples to one of the plurality of tab cavities to secure the adjustable base. The apparatus also includes a connector system coupled to the adjustable base.

9 Claims, 6 Drawing Sheets

PORTABLE COMPUTER UNIVERSAL SERIAL BUS DEVICE WITH AN EXTENDABLE CONNECTOR SECURED BY MULTIPLE LOCKING MECHANISMS

FIELD OF INVENTION

The present invention relates generally to a device and more particularly to an extendable connector on such a device.

BACKGROUND OF INVENTION

Many efforts have been made to improve the design of electronic devices, such as USB devices. However, many of these designs cause additional problems in the device. For example, U.S. Pat. No. 6,808,400 discloses an USB device that utilizes a latch/clip on one side of a drive and uses spring tension to control the slide movement. Typically, due to metal fatigue, a spring's force diminishes, as the USB device is retracted for an extended length of time, which eventually shortens the productive life span of the device.

U.S. Pat. No. 7,004,780 discloses a new design for an USB device, but requires an user to apply a force to a printed circuit board assembly (PCBA) to release a set of slide locks to enable the sliding motion. It has been observed that applying force to a PCBA results in damage to trace connections.

Accordingly, what is desired is a device that overcomes the aforementioned issues and provides improved performance.

BRIEF SUMMARY OF THE INVENTION

An apparatus for use within electrical devices is disclosed. The apparatus comprises a casing having an upper body and a lower body, the casing including a tab disposed on a surface thereof and an adjustable base having a plurality of tab cavities adjacent to the tab. The tab engagingly couples to one of the plurality of tab cavities to secure the adjustable base. The device also includes a connector system coupled to the adjustable base.

It is an advantage of the present invention to provide an apparatus that includes a casing design that enables a connector system of the device to extend and retract utilizing multiple slide-locking mechanism.

BRIEF DESCRIPTION OF SEVERAL VIEWS OF THE DRAWINGS

The present invention is illustrated by way of example and not limitation in the figures of the accompanying drawings, in which like references indicate similar elements, and in which.

DETAILED DESCRIPTION OF THE INVENTION

The present invention relates generally to a device casing and more particularly to an extendable connector on such a device. The following description is presented to enable one having ordinary skill in the art to make and use the invention and is provided in the context of a patent application and the generic principles and features described herein will be apparent to those skilled in the art. Thus, the present invention is not intended to be limited to the embodiments shown, but is to be accorded the widest scope consistent with the principles and features described herein.

The device of the present invention may be directed to electronic devices such as a USB device as well as various computer peripheral devices that are connected by plug connectors to a host computer system to perform various functions. Accordingly, it will be appreciated that the present invention is applicable to any and all pocket-sized computer peripheral device types that are readily transportable and which may be advantageously interconnected with various host computer systems (i.e. any electronic computer of any type or size including desktop computers, notebook computers, palmtop computers, and personal digital assistant devices). For example, flash memory storage devices, communication devices, scanners, and cameras are all applicable pocket-sized computer peripheral devices to the present invention.

Accordingly, it will be appreciated by one having ordinary skill in the art that the present invention is applicable, in general, to electronic devices and is therefore not limited to USB devices. Therefore, one having ordinary skill in the art will readily recognize that there could be variations to the USB device embodiments and those variations would be within the spirit and scope of the present invention.

Figure 1:
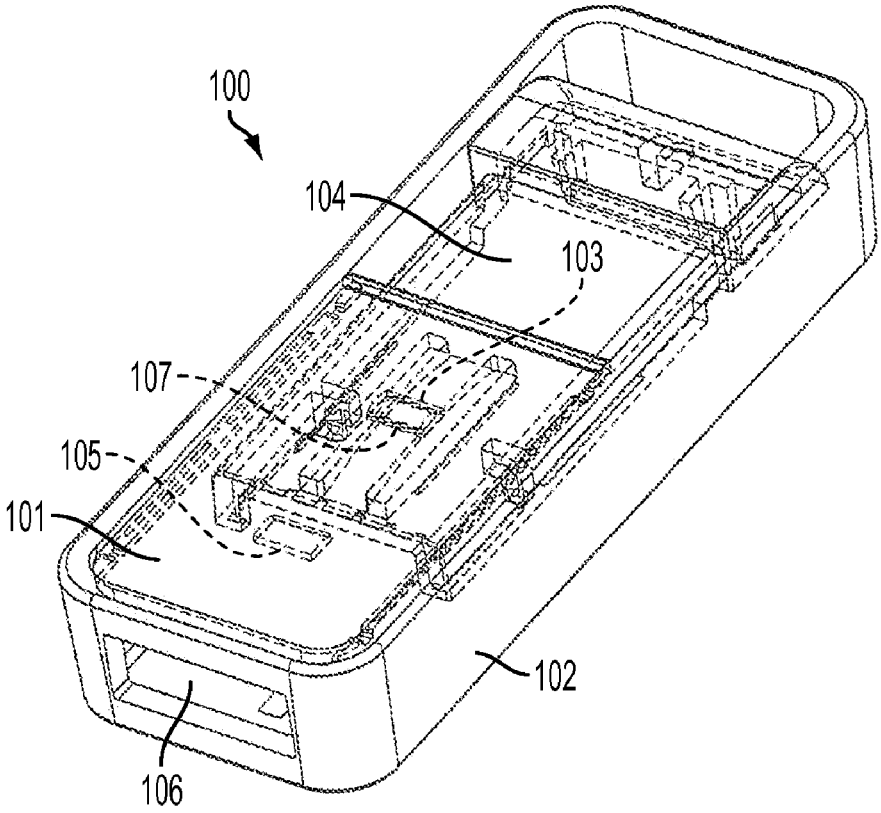
FIG. 1 shows a perspective view of an Universal Serial Bus device with an internal slide mechanism, according to an embodiment.

FIG. 1 shows a perspective view of an Universal Serial Bus device 100 with an internal slide mechanism, according to an embodiment. For an embodiment, Universal Serial Bus device 100 comprises an adjustable base 101, a first housing 102, tab 103, inner surface 104, tab recesses 105/107, connector system 106, and a printed circuit board assembly (not shown). The perspective of Universal Serial Bus device 100 shows connector system 106 retracted within the first casing 102. That is, tab 103 is locked in place by tab recess 107 such that connector system 106 is in the furthest position (according to a design embodiment) within casing 102 (and a set of slot pins locked in place within a set of locking cavities—described in more detail below). For an embodiment, connector system 106 is completely within casing 102 such that connector system 106 is not exposed and the first casing 102 provides protection thereto.

Figure 2:
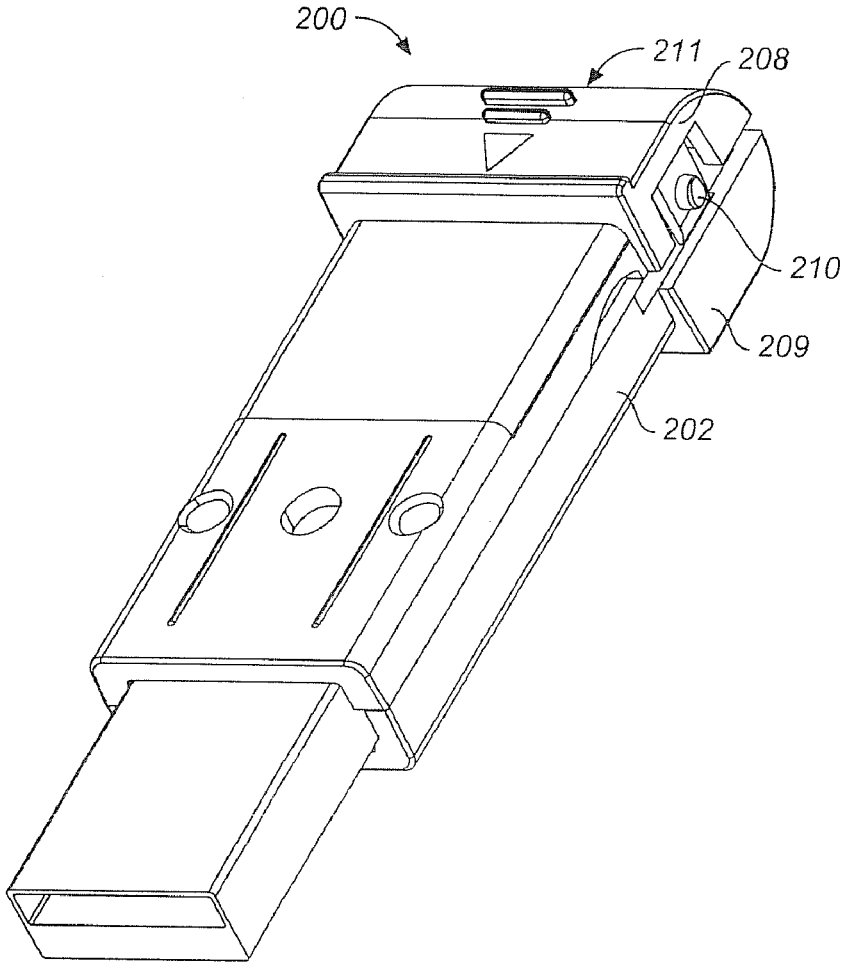
FIG. 2 shows the main body, locking pins, and compression area of a Universal Serial Bus device, according to an embodiment.
Figure 3:
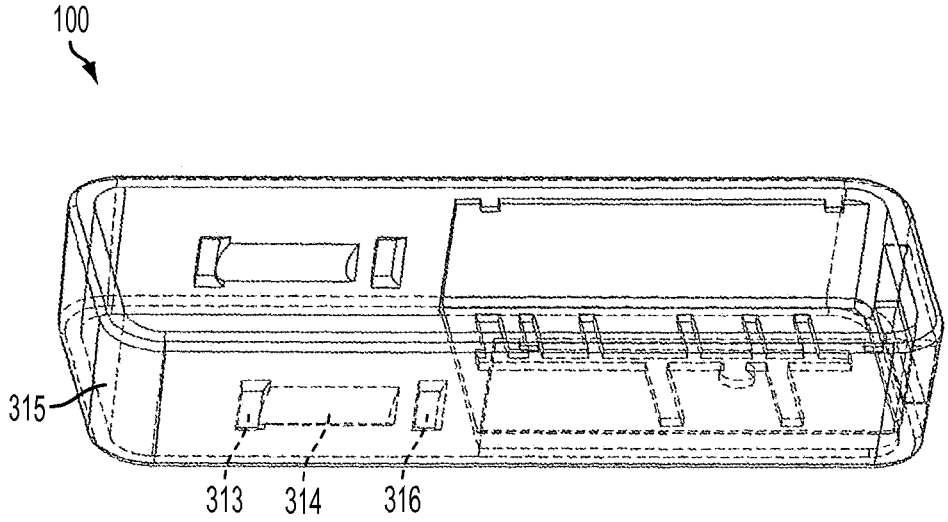
FIG. 3 shows a slot and locking cavities embedded in an inner surface the Universal Serial Bus device casing, according to an embodiment.

FIG. 2 shows a side view of a Universal Serial Bus device 200 showing a second casing 202, upper body 208, lower body 209, slot pin 210, and compression area 211. According to an embodiment, the slide mechanism of a Universal Serial Bus device housing 200 is enabled in the event that a user compresses the Universal Serial Bus device housing 200 along the upper body 208 within compression area 211. For embodiments, vertical compression enables the slide-locking mechanism of Universal Serial Bus device housing 200. Upon compression, slot pin 210 along with an other corresponding slot pin disposed on an opposite side of Universal Serial Bus device housing 200, shifts downwards to contact lower body 209 and also inward underneath casing 202 along pin slots embedded in the Universal Serial Bus device 100 as further shown in FIG. 3.

As shown, pin slots 314 are embedded horizontally along an inner surface 315 of Universal Serial Bus device 100. As stated, when the slide-mechanism is enabled a set of slot pins are forced out of their locking positions in the first set of locking cavities 313 and are guided along pin slots 314 to a second set of locking cavities 316. Once the slot pins reach the second set of locking cavities, they are locked in place. That is, when the slot pins are laterally forced from a first set of locking cavities 313 they travel along pin slots 314 until they are locked in a second set of locking cavities 316. The first set of locking cavities 313 may define the retract or extend position for an Universal Serial Bus connector system. Conversely, the second set of locking cavities 316 may define the retract or extend position for an Universal Serial Bus connector system, depending on the defined designation of the first set of locking cavities. For example, if the first set of locking cavities defines a retract position for an Universal Serial Bus connector system when a set of slot pins are locked therein, then the second set of locking cavities defines an extend position for an Universal Serial Bus connector system when a set of slot pins are locked therein.

It can be appreciated that the term "lock", "locking", and other verb tenses of the term refers to fastening, fixing, securing, or holding in place. Accordingly, the slot pins described above are locked, fastened, fixed, secured, or held in place within the locking cavities.

For an embodiment, the distance that the set of slot pins travel to and from the first and second set of cavities defines the length that the connector system can extend or protract beyond the casing (housing or frame) of the Universal Serial Bus device or the distance the connector system can retract or withdraw within. In an embodiment, the connector system extends approximately 12 mm beyond the casing of the Universal Serial Bus device.

For an embodiment, the set of slot pins may feature tapered edges. For an embodiment, "tapered" may be defined as a gradual dimunition of thickness, diameter, or width in an elongated object. For embodiments, the set of slot pins may be tapered to assist the slot pins move within the Universal Serial Bus device once the sliding mechanism is enabled. Additionally, the set of locking cavities may be designed to effectively lock the slot pins in place in the event that the Universal Serial Bus connector system is positioned in a retract or extend state. For an embodiment when the set of slot pins feature tapered edges, the set of slot pins "snap" into place once the slot pins reach the set of locking cavities. Once the slot pins snap in place, the locking cavities provide a tight, flush fit for the slot pins therein.

For an embodiment, the aforementioned procedure defines a first locking mechanism such that an Universal Serial Bus device maintains a static position upon full retraction or extension. For the embodiment, the first locking mechanism is featured along the side of a USB casing.

Figure 4:
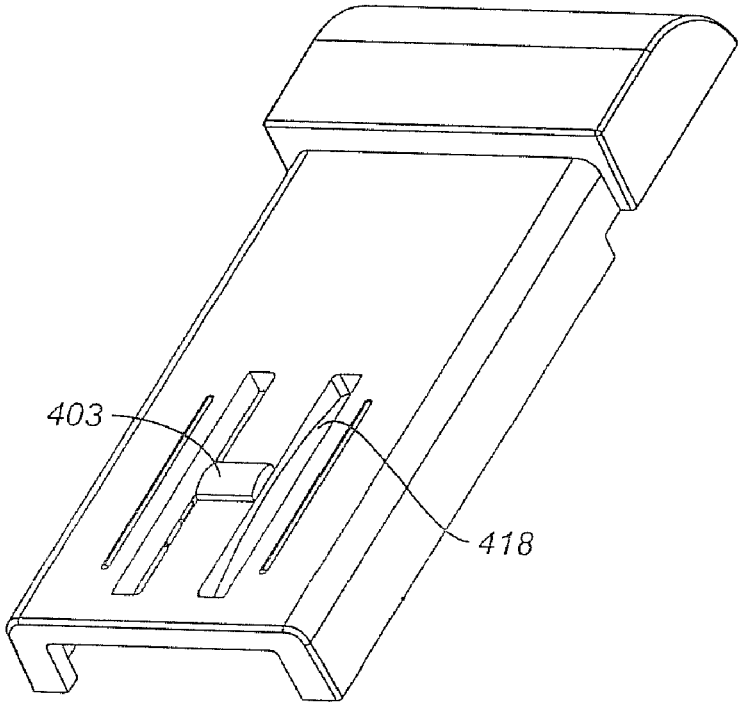
FIG. 4 shows a tab of a secondary latch, according to an embodiment.
Figure 5:
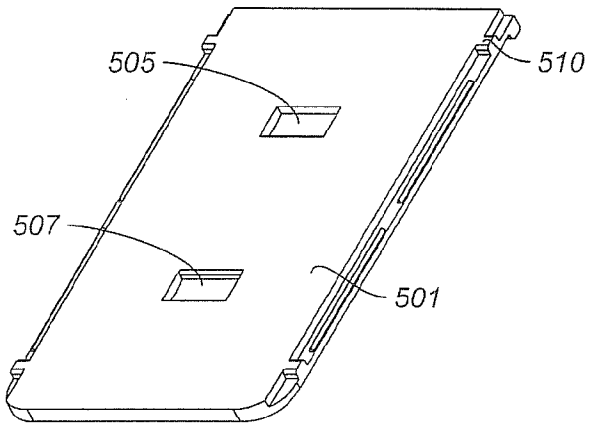
FIG. 5 shows recessed tab cavities for the secondary latch.
Figure 7:
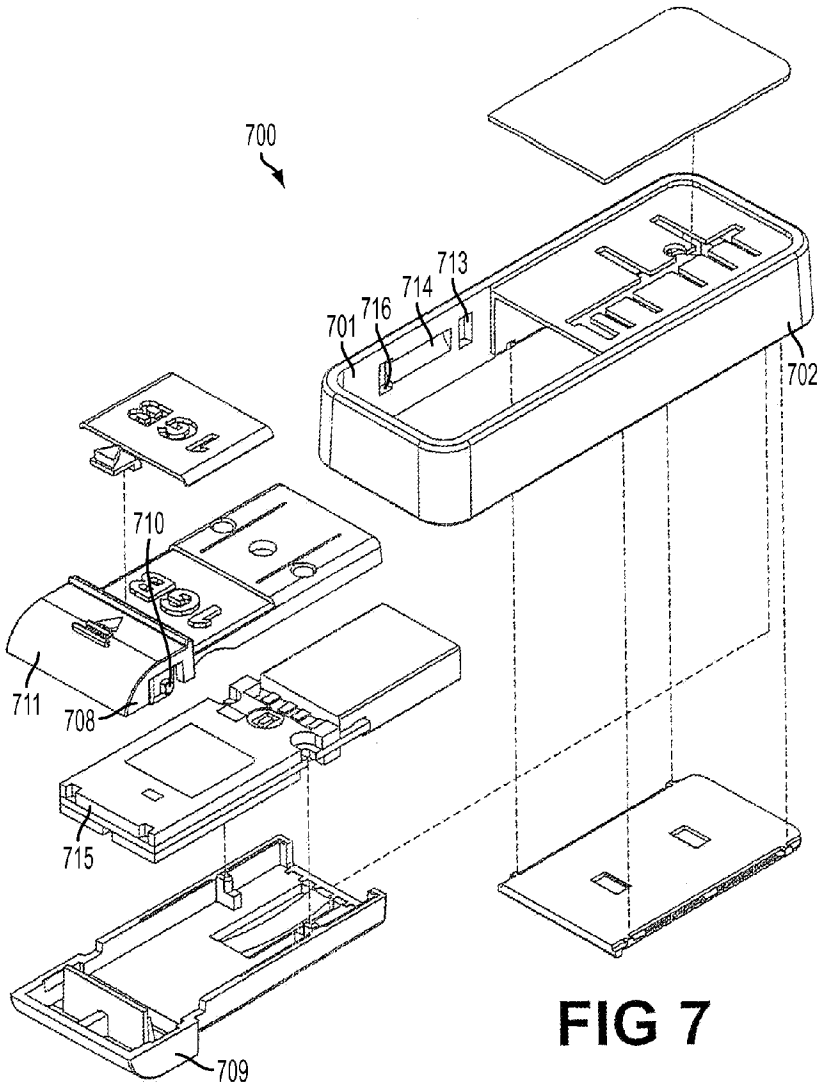
FIG. 7 shows an exploded view of a Universal Serial Bus device that includes a casing design and a connector system that extends and retracts using a multiple slide-lock mechanism.

The Universal Serial Bus device of the present invention also includes a second locking mechanism shown by FIG. 4 and FIG. 5, according to an embodiment. Accordingly, FIG. 4 shows an inner surface of an Universal Serial Bus device housing 200 (FIG. 2) featuring a tab 403 disposed on a surface of a third casing 402, and a set of guides 418, according to an embodiment. For an embodiment, tab 403 functions as a secondary latch for an Universal Serial Bus device such that tab 403 provides an additional lock when the connector system is set in the retracted or extended position.

For an embodiment, tab 403 comprises a spring section. For the embodiment, the spring section enables the adjustable base to slide along a set of guides embedded along the inner surface of the Universal Serial Bus housing (casing) with minimal resistance. As such, a Universal Serial Bus connector system can extend and retract freely between the first and second locking positions. For the embodiment, tab 403 compresses slightly when the adjustable base slides thereto and therefrom.

For other embodiments, tab 403 also includes tapered edges as shown in FIG. 4. For the embodiment, a tapered tab 403 assists the slot pins move within the Universal Serial Bus device once the sliding mechanism is enabled such that the Universal Serial Bus connector system extends and retracts freely between the first and second locking positions.

FIG. 5 shows a perspective view of a second adjustable base 501 which includes a tab set of slot pins 510 and a set of recessed tab cavities 505, 507 for the secondary latch 403 of FIG. 4, according to an embodiment. In the event that the Universal Serial Bus connector system transitions from a retracted to an extended position, the tab 403 disposed within the Universal Serial Bus device shifts to the corresponding recessed tab cavity. For example, recessed tab cavity 505 may represent the locking position where an Universal Serial Bus connector system is in the extended position. Likewise, recessed tab cavity 507 represents the locking position where an Universal Serial Bus connector system is in the retracted position. Accordingly, adjustable base 501 shifts between recessed tab cavity 505 and 507 to extend or retract an Universal Serial Bus connector system. As stated above, tapered tabs having a spring member and tapered slot pins may enable adjustable base 501 to slide within the casing with minimal obstruction, impedance, or resistance.

For an embodiment, the aforementioned procedure defines a secondary locking mechanism. For embodiments, the secondary locking mechanism works in tandem with the first locking mechanism described above. For example, when a USB connector system is fully extended both locking mechanisms are enabled. That is, a set of slot pins are locked within a set of locking cavities and a tab is locked within a tab recess cavity that defines an extended position for the USB connector system. Likewise, a set of slot pins are locked within a set of locking cavities and a tab is locked within a tab recess cavity that defines a retracted position for the USB connector system. Additionally, the secondary locking mechanism is featured along the bottom of the USB casing.

Figure 6:
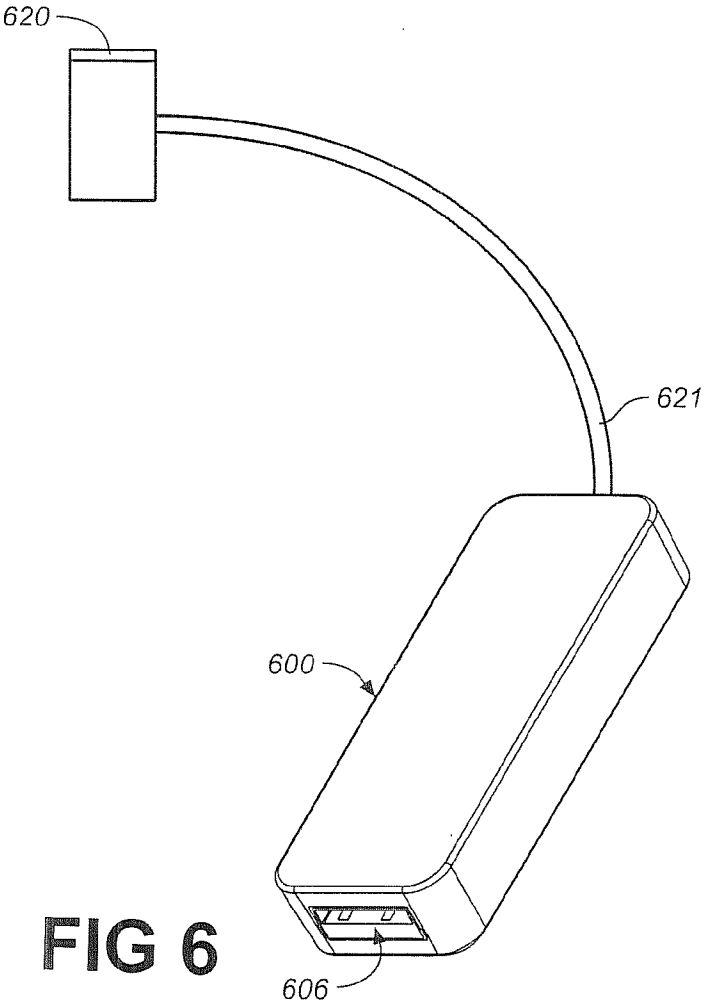
FIG. 6 shows a USB device having a cable, and first and second connectors systems thereto.

Additionally, the Universal Serial Bus device of the present invention may also feature a cable and a second connector system attached thereto such that the USB device can electrically couple to various electronic devices, according to an embodiment. Accordingly, FIG. 6 shows a USB device 600 featuring a first connector system 606, second connector system 620, and a cable 621. For the embodiment, the USB device 600 can be connected to a host computer via first connector system 606 and various other electronic devise by second connector system 620 via cable 621. As such, USB device 600 can be connected to a host computer.

Additionally, it will be appreciated that the USB casing (housing or frame) is waterproof, according to an embodiment. A waterproof casing can protect a USB embedded within mobile products that are exposed to moisture.

It will also be appreciated that a double injection molding process is used to apply alphanumeric characters to an USB casing to ensure that the lettering remains legible.

It will also be appreciated that during assembly a printed circuit board assembly (PCBA) is first cleaned using a degreasing solution and subsequently coated with a membrane thereto in a vacuum environment to ensure the moisture-proof protective casing can be driven under low standoff components.

It will further be appreciated that an USB casing contains a recessed plate to allow co-branding with other products used in conjunction with an USB device.

Although the present invention has been described in accordance with the embodiments shown, one having ordinary skill in the art will readily recognize that there could be variations to the embodiments and those variations would be within the spirit and scope of the present invention. Accordingly, it will be appreciated by one having ordinary skill in the art that the present invention is applicable in general to electronic devices and is therefore not limited to USB devices. Additionally, many modifications may be made by one having ordinary skill in the art without departing from the spirit and scope of the appended claims.

What is claimed is:

1. A Universal Serial Bus device assembly, comprising a housing wherein the housing comprises an adjustable base:

a casing having an upper body and a lower body, the casing including a tab disposed on the bottom surface of the casing and an adjustable base having a plurality of tab cavities adjacent to the tab and wherein when the tab is engagingly coupled to one of the plurality of tab cavities the adjustable base is secured to the casing; and a first tapered slot pin and a second tapered slot pin disposed between the upper body and the lower body; a first pin slot and a second pin slot, both having a first end and a second end disposed inside of the housing;

a printed circuit board assembly disposed within the casing;

a connector system coupled to the casing; and a first set of locking cavities coupled to the first ends and a second set of locking cavities coupled to the second ends and wherein when the first and second tapered slot pins are engagingly coupled to one of the set of locking cavities the connector system is secured to the housing.

2. The Universal Serial Bus device assembly of claim 1, wherein the plurality of tab cavities comprises a first tab cavity wherein when the tab is engagingly coupled thereto the connector system is in a retracted position and a second tab cavity wherein when the tab is engagingly coupled thereto the connector system is in an extended position.

3. The Universal Serial Bus device assembly of claim 1, wherein when the first and second slot pins are engagingly coupled to the first set of locking cavities the connector system is in a retracted position and when the first and second tapered slot pins are engagingly coupled to the second set of locking cavities the connector system is in an extended position.

4. The Universal Serial Bus device assembly of claim 1, wherein the tab comprises a spring section.

5. The Universal Serial Bus device assembly of claim 1, wherein the first set of locking cavities and the second set of locking cavities are first and second locking points and wherein the set tab of cavities is a third locking point.

6. A Universal Serial Bus device assembly, comprising a housing wherein the housing comprises an adjustable base:

a casing having an upper body and a lower body, the casing including a tab disposed on the bottom surface of the casing thereof and an adjustable base having a plurality of tab cavities adjacent to the tab and wherein when the tab is engagingly coupled to one of the plurality of tab cavities the adjustable base is secured to the casing;

a first tapered slot pin and a second tapered slot pin disposed between the upper body and the lower body; the first pin slot and a second pin slot, both having a first end and a second end disposed inside the housing;

a printed circuit board assembly disposed within the casing;

a connector system coupled to the casing; and a first set of locking cavities coupled to the first ends and a second set of locking cavities coupled to the second ends, wherein when the first and second tapered slot pins are engagingly coupled to the first set of locking cavities the connector system is in a retracted position and when the first and second tapered slot pins are engagingly coupled to the second set of locking cavities the connector system is in an extended position.

7. The Universal Serial Bus device assembly of claim 6, wherein the first and second tapered slot pins, first and second pin slots, and first and second locking pin cavities are components of a first locking mechanism.

8. The Universal Serial Bus device assembly of claim 6, wherein the tab, set of tab cavities, and adjustable base are components of a second locking mechanism.

9. A Universal Serial Bus device assembly comprising:

a cable having a first and a second end, wherein the first end is coupled to a first connector system; and an apparatus coupled to the second end of the cable, the apparatus comprising a housing wherein the housing comprises an adjustable base: a casing having an upper body and a lower body, the casing including a tab disposed on the surface of the casing and an adjustable base having a plurality of tab cavities adjacent to the tab and wherein when the tab is engagingly coupled to one of the plurality of tab cavities the adjustable base is secured to the casing;

a printed circuit board assembly disposed within the casing; a second connector system coupled to the casing; and a first tapered slot pin and a second tapered slot pin disposed between the upper body and the lower body; the first pin slot and a second pin slot, both having a first end and a second end disposed inside of the housing; a first set of locking cavities coupled to the first ends and a second set of locking cavities coupled to the second ends and wherein when the first and second tapered slot pins are engagingly coupled to one of the set of locking cavities the second connector system is secured to the housing.

* * * * *